US006985295B2

(12) United States Patent
Ahn et al.

(10) Patent No.: US 6,985,295 B2
(45) Date of Patent: Jan. 10, 2006

(54) LIGHT DIFFUSING FILM

(75) Inventors: Cheol Heung Ahn, Cheonan (KR); Chi Yook Moon, Cheonan (KR)

(73) Assignee: SKC Co., Ltd., Kyungki-do (KR)

( * ) Notice: Subject to any disclaimer, the term of this patent is extended or adjusted under 35 U.S.C. 154(b) by 158 days.

(21) Appl. No.: 10/482,365

(22) PCT Filed: Jun. 30, 2001

(86) PCT No.: PCT/KR01/01120

§ 371 (c)(1),
(2), (4) Date: Dec. 30, 2003

(87) PCT Pub. No.: WO03/005071

PCT Pub. Date: Jan. 16, 2003

(65) Prior Publication Data

US 2004/0233536 A1 Nov. 25, 2004

(51) Int. Cl.
*G02B 13/20* (2006.01)

(52) U.S. Cl. ..... 359/599; 359/582; 359/577

(58) Field of Classification Search ..... 359/599, 359/707, 577, 580, 582; 362/608; 428/1.3, 428/147, 327

See application file for complete search history.

(56) References Cited

U.S. PATENT DOCUMENTS

| | | | | |
|---|---|---|---|---|
| 5,903,391 | A | 5/1999 | Toshima et al. | |
| 6,483,611 | B1 * | 11/2002 | Mizutani et al. | 359/3 |
| 6,602,596 | B2 * | 8/2003 | Kimura et al. | 428/327 |
| 2002/0146518 | A1 * | 10/2002 | Kusume et al. | 428/1.33 |

FOREIGN PATENT DOCUMENTS

| | | |
|---|---|---|
| JP | 5-281403 | 10/1993 |
| JP | 10-46018 | 2/1998 |
| JP | 2000-39506 | 2/2000 |

* cited by examiner

*Primary Examiner*—Fayez G. Assaf
(74) *Attorney, Agent, or Firm*—Nixon & Vanderhye, P.C.

(57) ABSTRACT

A light diffusing film which has an excellent luminance characteristic and excellent thermal properties and which exhibits no deterioration in light transmittance. The light diffusing film according to the present invention, which has a transmittance of 88% or greater with respect to light having a wavelength 400 to 900 nm, a haze of 1.2 or less, and a $H_t/H_m$, percentage in the range of 50 to 100, exhibits excellent luminance and thermal properties, so that it can be suitably used in various kinds of picture display devices, in particular, in a display device employing LED (light emitting diode) lamps or an LCD (liquid crystal display device) backlighting system.

5 Claims, No Drawings

LIGHT DIFFUSING FILM

TECHNICAL FIELD

The present invention relates to a light diffusing film, and more particularly, to a light diffusing film which has an excellent luminance characteristic and excellent thermal properties and which exhibits no deterioration in light transmittance.

BACKGROUND ART

In industry, polymeric resin films have a wide variety of applications including bases for packing, photographic films, condensers, electric insulators, labels, magnetic recording media, medical purposes. In recent years, polymeric resin films have also been in widespread use as base materials for picture display devices such as rear projection type screens, plasma display panels or liquid crystal display devices.

Since light diffusing film bases require high transparency, resin films prepared from transparent polymeric resin, such as polyester resin, polyacryl resin or polycarbonate resin, are mainly used in the light diffusing films.

Specifically, polyethylene terephthalate (PET) films are commonly used since they are cheap, highly transparent and sufficiently resistant to light and heat emitted from a backlighting unit, and have excellent mechanical strength and processibility.

However, since PET has organic or inorganic particles added to the inside or surface thereof for the purpose of increasing processibility and durability, the ability to control its transparency is unavoidably limited.

DISCLOSURE OF THE INVENTION

To solve the above-described problems, it is an object of the present invention to provide a light diffusing film having an excellent luminance characteristic and excellent thermal properties while exhibiting no deterioration in light transmittance.

To accomplish the above object, there is provided a light diffusing film having, on at least one surface of a base film, a light diffusing layer made of an inorganic or organic light diffuser and a binder resin, wherein the base is a polymeric resin film without a filler, satisfying the following formulae 1, 2 and 3:

$$T = \frac{I}{I_o} \times 100 \geq 88\%, \qquad \text{[Formula 1]}$$

wherein T is the transmittance of the base film with respect to light having a wavelength of 400 to 900 nm, I is the intensity of light after passing through the base film, $I_o$ is the intensity of light before passing through the base film;

$$\text{Haze } (\%) = \frac{T_d}{T} \times 100 \leq 1.2, \qquad \text{[Formula 2]}$$

wherein T is the transmittance of the base film with respect to light having a wavelength of 400 to 900 nm, and $T_d$ is the diffusing transmittance;

$$50\% \leq \frac{H_t}{H_m} \times 100 \leq 100\%, \qquad \text{[Formula 3]}$$

wherein $H_t$ is the longitudinal heat shrinkage of the base film, being 1.0 or less, and $H_m$ is the transverse heat shrinkage of the base film, being 1.0 or less.

The thickness of the base is preferably in the range of 50 to 300 μm, and the base has a weight average molecular weight of 10,000 to 50,000.

Also, the base is formed of a polyethylene terephthalate (PET) film.

In another aspect of the present invention, there is provided a display device employing LED (light emitting diode) lamps or an LCD (liquid crystal display device) backlighting system, and comprising the light diffusing film.

BEST MODE FOR CARRYING OUT THE INVENTION

The transmittance of a base used in the light diffusing film of the present invention is preferably maintained at greater than or equal to 88%. If the transmittance is less than 88%, that is, the light transmittance is lowered, the luminance characteristic of the film may deteriorate.

As expressed in Formula (1), in order to maintain the transmittance of a base at greater than or equal to 88%, it is necessary to control absorptivity, concentration and thickness, which are influential factors with respect to the value of T. In particular, the absorptivity has a constant value according to the material used, and is affected by the concentration of a base resin. The concentration of a film can be controlled by adjusting the weight average molecular weight of the base.

The weight average molecular weight of the base resin is preferably in the range of 10,000 to 50,000. If the weight average molecular weight of the base resin is less than 10,000, the processibility and mechanical strength may deteriorate. If the weight average molecular weight of the base resin is greater than 50,000, elongation is difficult to achieve.

Since the concentration of the base film is more affected by scattering or absorbance due to impurities present in the base than by the concentration of the resin itself, the film is preferably formed of only PET without using filler.

Another factor affecting the transmittance is the thickness of a film, which is preferably 50 to 300 μm. If the thickness of a film is greater than 300 μm, while the handling property of the film is good, the transparency thereof may deteriorate and miniaturization of a liquid crystal backlighting unit cannot be achieved. If the thickness of a film is less than 50 μm, while the transparency of the film is excellent, the handling property thereof may become inferior.

The haze value of the base used in the light diffusing film according to the present invention is less than or equal to 1.2. If the haze value is greater than 1.2, the transmittance of the light diffusing film is lowered, resulting in a reduction of luminance, from which diffused reflection or extinction may result. Thus, it is necessary to eliminate the filler.

In particular, if two or more light diffusing films manufactured by using base films without a filler, having transmittance of 88% or greater and a haze value of 1.2 or less, are laminated, the luminance can be enhanced compare to the conventional base resin. This is because the filler present in the base affects deterioration of optical transmittance more greatly when two or more laminated light diffusing films are used than when a single light diffusing film is used. Also, in order to enhance the luminance of a liquid crystal backlighting unit, lamination of two or three light diffusing films is quite often employed. Thus, it is very important to evaluate the optical property of lamination.

Not only optical properties but also thermal properties of a base film used as a light diffusing film must be considered. An insufficient thermal property may cause shrinkage or dilation of the light diffusing film due to heat emitted from the light source of a liquid crystal backlighting unit, resulting in curling, thereby making it difficult to use the base film as a light diffusing film.

When the longitudinal and transverse heat shrinkage ratio ($H_m$, $H_t$) is 1.0 or less and the longitudinal and transverse heat shrinkage percentage ($H_t/H_m$) is preferably in the range of 50%–100%, the light diffusing film does not curl. Conversely, if the longitudinal and transverse heat shrinkage percentage is greater than 100% or less than 50%, curling occurs due to a difference in longitudinal and transverse balance, thereby lowering the uniformity in the luminance of the liquid crystal backlighting unit.

The light diffusing film satisfying the above-described requirements can be manufactured by general film making methods. A PET base film is coated with a binder resin solution having a uniformly dispersed light diffuser having an average particle size of 1 to 50 μm and then dried, thereby forming a desired light diffusing film.

Methods of coating a light diffusing composition on a base film include methods generally known in the art without limitation, and usable coating methods include air knife coating, gravure coating, reverse roll coating, spray coating and blade coating.

After the base film is coated with the light diffusing composition, the resultant structure is heated by hot air, infrared rays or far infrared rays, thereby forming a coating layer.

The present invention will now be described more fully with reference to the following examples. The invention may, however, be embodied in different forms and should not be construed as limited to the examples set forth herein. Rather, these examples are provided so that this disclosure will be thorough and complete, and will fully convey the scope of the invention to those skilled in the art.

EXAMPLE 1

A light diffusing composition having the following constituents was coated on a 100 μm thick PET film (Model No. SH31 of SKC Co., Ltd., Korea) with a transmittance of 88% with respect to light having a wavelength 400 to 900 nm, a haze of 0.8, a $H_t/H_m$ percentage of 63.0%, and no filler included, at a dose of 13 g/m$^2$ using a 0.3 mm myer bar and dried at 120° C. for 3 minutes, thereby manufacturing a light diffusing film. The luminance characteristics for one-sheet and two-sheet films and $H_t/H_m$ percentages were measured, and the results thereof are listed in Table 1.

| | |
|---|---|
| Binder resin (Nipporan 125, Nippon Polyurethane Co.) | 25.4 parts by weight |
| Curing agent (Coronate HX, Nippon Polyurethane Co.) | 2.9 parts by weight |
| Light diffuser (Epostar MA-1010, Japan Catalyst Co., Ltd.) | 20.5 parts by weight |
| Solvent (MEK:toluene = 1:1) | 51.2 parts by weight |

EXAMPLE 2

A 100 μm thick PET film (Model No. SH35 of SKC Co., Ltd., Korea) with a transmittance of 89%, a haze of 0.8, a $H_t/H_m$ percentage of 62.4%, and no filler included, was used to manufacture a light diffusing film by the same equipment and method as in Example 1. The luminance characteristics for one-sheet and two-sheet films and $H_t/H_m$ percentages were measured, and the results thereof are listed in Table 1.

COMPARATIVE EXAMPLE 1

A 100 μm thick PET film (Model No. SG82 of SKC Co., Ltd., Korea) with a transmittance of 84%, a haze of 3.0, a $H_t/H_m$ percentage of 50.0%, and 0.05% by weight of a silica filler included, was used to manufacture a light diffusing film by the same equipment and method as those in Example 1. The luminance characteristics for one-sheet and two-sheet films and $H_t/H_m$ percentages were measured, and the results thereof are listed in Table 1.

| | |
|---|---|
| Binder resin (U1653C, SKC Co., Ltd.) | 28.5 parts by weight |
| Curing agent (Duranate P301-75E, Asahi Chemical Industries Co., Ltd.) | 2.4 parts by weight |
| Light diffuser (Techpolymer MBX-15, Sekisui Chemical Co., Ltd.) | 35.7 parts by weight |
| Solvent (MEK:toluene = 1:1) | 33.4 parts by weight |

COMPARATIVE EXAMPLE 2

A 100 μm thick PET film (Model No. SH71 of SKC Co., Ltd., Korea) with a transmittance of 86%, a haze of 1.5, a $H_t/H_m$ percentage of 55.1%, and 0.03% by weight of a titanium filler included, was used to manufacture a light diffusing film by the same equipment and method as in Example 1. The luminance characteristics for one-sheet and two-sheet films and $H_t/H_m$ percentages were measured, and the results thereof are listed in Table 1.

COMPARATIVE EXAMPLE 3

A 100 μm thick PET film (Model No. SH92 of SKC Co., Ltd., Korea) with a transmittance of 85%, a haze of 1.6, a $H_t/H_m$ percentage of 40.0%, and 0.03% by weight of a silica filler included, was used to manufacture a light diffusing film by the same equipment and method as in Example 1. The luminance characteristics for one-sheet and two-sheet films and $H_t/H_m$ percentages were measured, and the results thereof are listed in Table 1.

<Evaluation>

Curling Property

A light diffusing film was placed on a light guide plate of a liquid crystal backlighting unit and was allowed to stand for 500 hours, and then the highest edge of the film from the horizontal plane of the light guide plate was measured. Then, the curling property of the light diffusing film was rated as having one of the following grades:

good: the length of the highest edge of the film is less than or equal to 1 mm poor: the length of the highest edge of the film is greater than 1 mm.

Color Coordinates (x, y) and Luminance of One-Sheet Film

A sheet of a light diffusing film was placed on a light guide plate of a liquid crystal backlighting unit and the color coordinates and luminance were evaluated using a BM-7 tester available from TOPCON Co., Ltd.

Color Coordinates (x, y) and Luminance of Two-Sheet Film

Two sheets of light diffusing film were laminated and the color coordinates were measured using the same tester and method as in the case of the one-sheet film.

$H_t/H_m$ Percentage

A 2.5 cm×30 cm sample of a light diffusing film was exposed to 150° C. for 30 minutes in a longitudinal or transverse direction. Letting the initial longitudinal and transverse lengths of the sample be $H_{mo}$ and $H_{to}$, respectively, the longitudinal and transverse lengths of the sample after heat shrinkage, that is, $H_m$ and $H_t$, were determined from the following formulae (4):

[Formulae 4]

$$H_t = \frac{L_t}{L_{t_0}} \times 100(\%)$$

$$H_m = \frac{L_m}{L_{m_0}} \times 100(\%)$$

TABLE 1

| | | | Example 1 | Example 2 | Comparative Example 1 | Comparative Example 2 | Comparative Example 3 |
|---|---|---|---|---|---|---|---|
| transmittance (%) | | | 88 | 89 | 84 | 86 | 85 |
| Haze (%) | | | 0.8 | 0.8 | 3.0 | 1.5 | 1.6 |
| $H_t/H_m \times 100$ | | | 63.0 | 62.4 | 50.1 | 55.1 | 40.2 |
| Content of Filler (%) | | | 0 | 0 | 0.05 | 0.03 | 0.03 |
| Curling property | | | good | good | good | good | poor |
| Color | 1 | X | 0.2913 | 0.2915 | 0.2820 | 0.2815 | 0.2811 |
| coordinates | sheet | Y | 0.3001 | 0.2998 | 0.2871 | 0.2869 | 0.2852 |
| | 2 | X | 0.2942 | 0.2939 | 0.2843 | 0.2840 | 0.2825 |
| | sheets | Y | 0.3010 | 0.3011 | 0.2905 | 0.2910 | 0.2868 |
| Luminance | 1 Sheet | | 1715 | 1720 | 1616 | 1624 | 1611 |
| (Cd/m$^2$) | 2 sheets | | 1860 | 1863 | 1702 | 1713 | 1698 |

As shown in Table 1, in Examples 1 and 2 in which the transmittance of the light diffusing film with respect to light having a wavelength 400 to 900 nm is 88% or greater, the haze is 1.2 or less, the $H_t/H_m$ percentage is in the range of 50 to 100, and no filler is included, the luminance characteristics are enhanced by approximately 6% owing to an increase in the transmittance of the base film, compared to the cases of Comparative Examples 1 through 3. the luminance characteristics are even further enhanced by using two laminated light diffusing films. This result is presumably because there is no light loss due to the presence of filler in the base film. Also, as the heat shrinkage percentage increases, there is less curling, which means improvement in the luminance uniformity of a liquid crystal backlighting unit.

INDUSTRIAL APPLICABILITY

The light diffusing film according to the present invention, which has a transmittance of 88% or greater with respect to light having a wavelength 400 to 900 nm, a haze of 1.2 or less, and a $H_t/H_m$ percentage in the range of 50 to 100, exhibits excellent luminance and thermal properties, so that it can be suitably used in various kinds of picture display devices, in particular, in a display device employing LED (light emitting diode) lamps or an LCD (liquid crystal display device) backlighting system.

What is claimed is:

1. A light diffusing film having, on at least one surface of a base film, a light diffusing layer made of an inorganic or organic light diffuser and a binder resin, wherein the base is a polymeric resin film without a filler, satisfying the following formulae:

$$T = \frac{I}{I_o} \times 100 \geq 88\%,$$

wherein T is the transmittance of the base film with respect to light having a wavelength of 400 to 900 nm, I is the intensity of light after passing through the base film, $I_o$ is the intensity of light before passing through the base film;

$$\text{Haze } (\%) = \frac{T_d}{T} \times 100 \leq 1.2,$$

wherein T is the transmittance of the base film with respect to light having a wavelength of 400 to 900 nm, and $T_d$ is the diffusing transmittance;

$$50\% \leq \frac{H_t}{H_m} \times 100 \leq 100\%,$$

wherein $H_t$ is the longitudinal heat shrinkage of the base film, being 1.0 or less, and $H_m$ is the transverse heat shrinkage of the base film, being 1.0 or less.

2. The light diffusing film according to claim 1, wherein the thickness of the base is in the range of 50 to 300 $\mu$m.

3. The light diffusing film according to claim 1, wherein the base is formed of a polyethylene terephthalate (PET) film.

4. The light diffusing film according to claim 3, wherein the PET has a weight average molecular weight of 10,000 to 50,000.

5. A display device employing LED (light emitting diode) lamps or an LCD (liquid crystal display device) backlighting system, and comprising the light diffusing film according to claim 1.

* * * * *